US007364385B1

(12) United States Patent
Luke

(10) Patent No.: US 7,364,385 B1
(45) Date of Patent: Apr. 29, 2008

(54) PROTECTIVE FLOOD BARRIER

(76) Inventor: George Michael Luke, 713 Central Ave., Roanoke, AL (US) 36274

( * ) Notice: Subject to any disclaimer, the term of this patent is extended or adjusted under 35 U.S.C. 154(b) by 0 days.

(21) Appl. No.: 11/745,106

(22) Filed: May 7, 2007

Related U.S. Application Data

(60) Provisional application No. 60/843,552, filed on Sep. 11, 2006.

(51) Int. Cl.
*E02B 7/08* (2006.01)

(52) U.S. Cl. ..... 405/114; 405/115; 405/107

(58) Field of Classification Search ..... 405/107, 405/114, 115, 116
See application file for complete search history.

(56) References Cited

U.S. PATENT DOCUMENTS

| | | | | |
|---|---|---|---|---|
| 830,437 | A * | 9/1906 | Humphrey | 405/113 |
| 2,202,662 | A * | 5/1940 | Knight | 405/90 |
| 3,381,483 | A * | 5/1968 | Huthsing, Jr. | 405/262 |
| 4,375,929 | A | 3/1983 | Clark | |
| 4,582,451 | A * | 4/1986 | Hollander, Jr. | 405/105 |
| 4,913,594 | A * | 4/1990 | Sigourney | 405/285 |
| 5,077,945 | A | 1/1992 | Koeniger | |
| 5,118,217 | A | 6/1992 | Younes | |
| 5,460,462 | A * | 10/1995 | Regan | 405/96 |
| 6,042,301 | A | 3/2000 | Sovran | |
| 6,132,140 | A | 10/2000 | Kullberg | |
| 6,443,655 | B1 | 9/2002 | Bennett | |
| 6,450,733 | B1 * | 9/2002 | Krill et al. | 405/114 |
| 6,623,209 | B1 | 9/2003 | Waters, Jr. | |
| 6,662,520 | B1 | 12/2003 | Nelson | |
| 6,840,711 | B1 | 1/2005 | Martinez et al. | |
| 6,884,002 | B1 * | 4/2005 | Fuller | 405/114 |
| 7,303,358 | B1 * | 12/2007 | Fuller | 405/114 |
| 2003/0190193 | A1 | 10/2003 | Waters, Jr. | |
| 2004/0006937 | A1 | 1/2004 | Jones et al. | |
| 2004/0096275 | A1 | 5/2004 | Rorheim | |
| 2004/0194426 | A1 | 10/2004 | Shapero | |
| 2006/0124913 | A1 | 6/2006 | Keedwell | |

FOREIGN PATENT DOCUMENTS

| | | | |
|---|---|---|---|
| FR | 2876716 | A1 * | 4/2006 |
| GB | 2386633 | A * | 9/2003 |
| GB | 2420366 | A | 5/2006 |
| WO | WO9704177 | | 2/1997 |

* cited by examiner

*Primary Examiner*—Frederick L. Lagman
(74) *Attorney, Agent, or Firm*—C. Brandon Browning; Maynard Cooper & Gale, P.C.

(57) ABSTRACT

A flood control system including panels made from plastic sheeting adhered to a frame and stacked one on top of the other. The panels are held in position by a series of columns, each of the columns having an H-shaped cross section that provides for and defines panel receiving slot adapted and arranged to interact with gaskets on the panels to provide a water tight barrier.

20 Claims, 8 Drawing Sheets

PROTECTIVE FLOOD BARRIER

FIELD OF THE INVENTION

The present invention generally relates to flood control systems and, more particularly, to a system of protective flood panels that can be arranged and maintained in place by columns to form a barrier against flood waters.

BACKGROUND OF THE INVENTION

With the advent of improved weather tracking and forecasting systems, flooding caused by rising rivers and streams, excess run-off and severe rain storms can now often be predicted hours or days in advance. This allows for precautions to be taken to protect structures such as houses and office buildings that are located in the path of a looming flood. For example, sandbags are sometimes placed around a structure to slow, but not altogether stop, the entry of water into a structure while pumps are provided for removing the water from within the ring of sandbags. Other times, valuables located within a structure are moved to higher elevations within the structure to minimize the overall damage caused by flood waters. However, if sufficient advance notice is provided more effective precautions can be taken such as erecting temporary dams or barriers around structures that are capable of preventing all water from passing therethrough. Thus, there is needed a temporary dam or barrier system that can be quickly erected around buildings for providing a barrier against flood waters.

SUMMARY OF THE INVENTION

The present invention is directed to a modular, prefabricated system of protective flood panels that can be arranged to form a barrier against flood waters. In one aspect of the invention, the barrier comprises a plurality of panels each prepared from a plastic sheet arranged on a frame to provide a substantially water-impermeable layer. The frame includes a top side, a bottom side, a pair of lateral sides and a plurality of reinforcement pieces connected to and between the pair of lateral sides. A first gasket is adhered to an exterior surface of the water-impermeable layer that extends between the top side and the bottom side adjacent to one of the pair of lateral sides. A second gasket is adhered to the exterior surface of the water-impermeable layer that extends parallel to the first gasket and adjacent to the other one of the pair of lateral sides. A third gasket is adhered to an exterior surface of the bottom side of the frame. A pair of columns, each of the columns having an H-shaped cross section is provided and anchored to a concrete foundation that surrounds the structure to be protected. The H-shaped cross-section forms in each a column a pair of oppositely facing panel receiving slot. In use, the panels are arranged one panel on top of another panel with the third gasket of each panel being brought into contact with either the concrete foundation or top side of another panel to provide a water impermeable seal therebetween. The panels are maintained in place by stacking them within and between the panel receiving slots of the pair of columns with the first gasket of each panel being pressed against the panel receiving slot of one of the pair of columns and the second gasket being pressed against the panel receiving slot of the other one of the pair of columns. This way, a water impermeable seal is created between the panels and the columns.

In further aspect of the invention, the barrier includes a plurality of the panels, a central column having an H-shaped cross section providing for a first panel receiving slot, and a corner column including a first elongate piece having an H-shaped cross section providing a second panel receiving slot and a second elongate piece connected directly to the first elongate piece and also having an H-shaped cross section providing a third panel receiving slot. In use, the panels are arranged one panel on top of another panel, as described above, and between the central column and the corner column with the first gasket of each of the panels being pressed against the first panel receiving slot and the second gasket of each portion of panels being pressed against the second panel receiving slot.

In yet another aspect of the invention, there is provided a method of protecting an area from flooding including providing a plurality of the panels, erecting a number of columns around the area to be protected, each column having an H-shaped cross section providing for oppositely facing panel receiving slots and arranging the panels one panel on top of another panel, as described above, and between the columns with the first gasket of each panel being pressed against the panel receiving slot of one column and the second gasket being pressed against the panel receiving slot of an adjacent column.

DETAILED DESCRIPTION OF THE DRAWINGS

Figure 1:
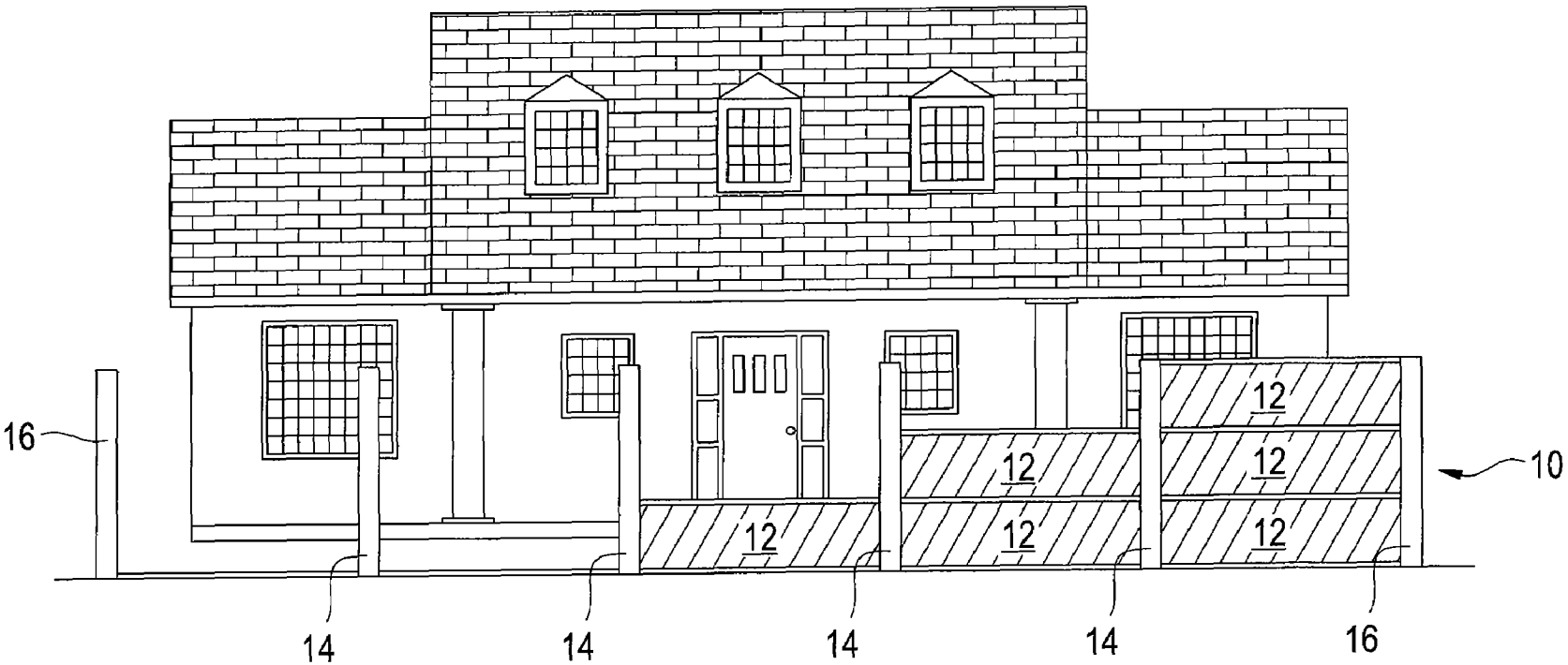
FIG. 1 is a plan view of the front side of a partially erected flood barrier system in accordance with the present invention.

A flood barrier 10 in accordance with the presently preferred embodiment of the present invention is illustrated in FIGS. 1 through 8, where like features of the invention share like numbering. As illustrated in FIG. 1, barrier 10 generally includes a number of rectangular panels 12 stacked one on top of another and maintained in place by a network of columns including middle columns 14 and corner columns 16 located about a structure in danger of flooding. Panels 12 interact with the ground or any other surface on which barrier 10 is placed, columns 14 and 16 and each other to provide a water-impermeable wall around the structure.

Figure 2:
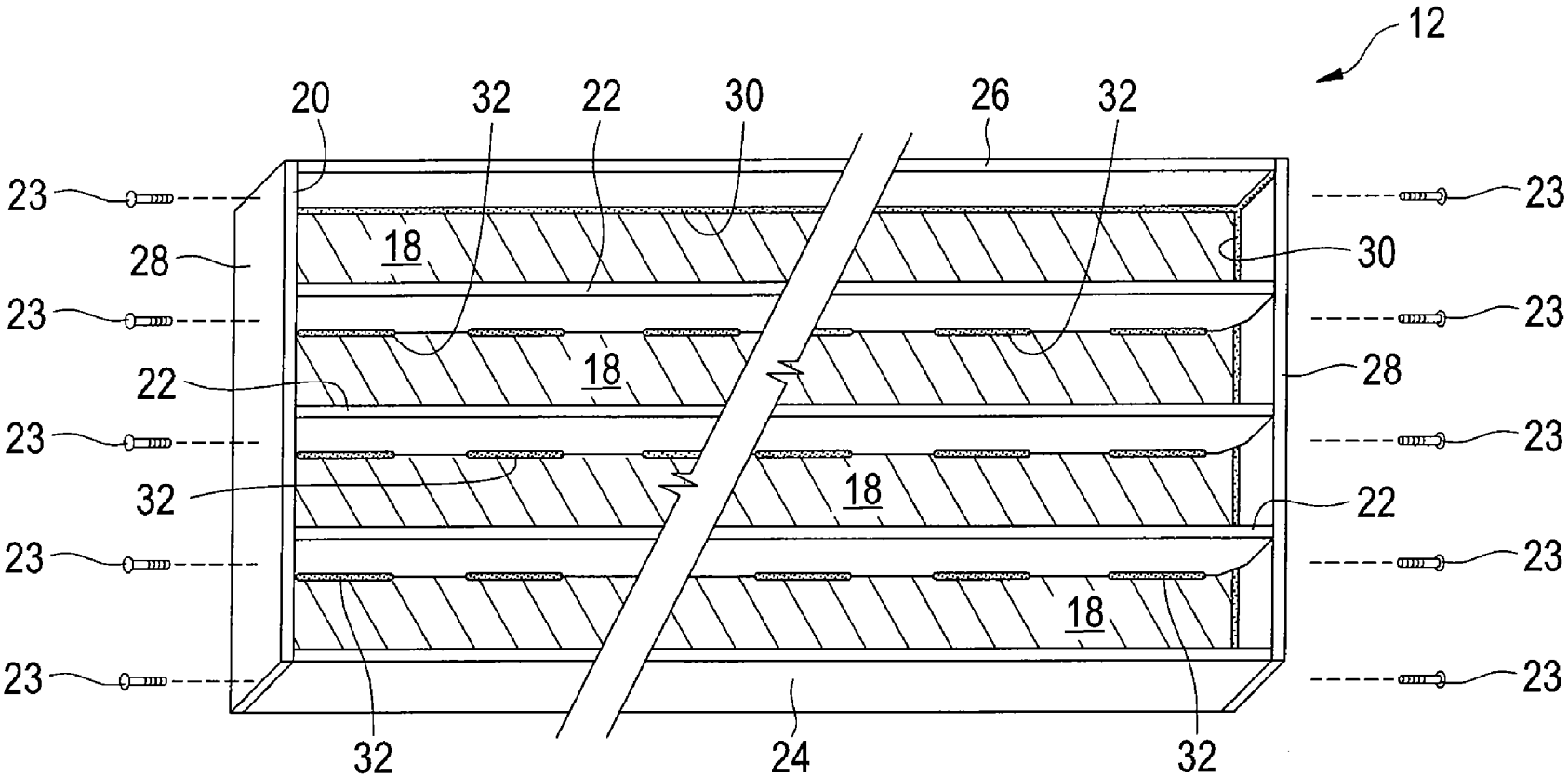
FIG. 2 is a perspective view of the back side of an individual panel of the flood barrier system of FIG. 1.

Referring to FIG. 2, each panel 12 is constructed of a relatively thin but rigid plastic sheeting 18 arranged and secured across a plastic, rectangular frame 20 to form a water impermeable panel surface. It is preferred that sheeting 18 has a thickness of not less than 0.125 inch, and more preferably, that sheeting 18 has a thickness of 0.187 inch.

Figure 3:
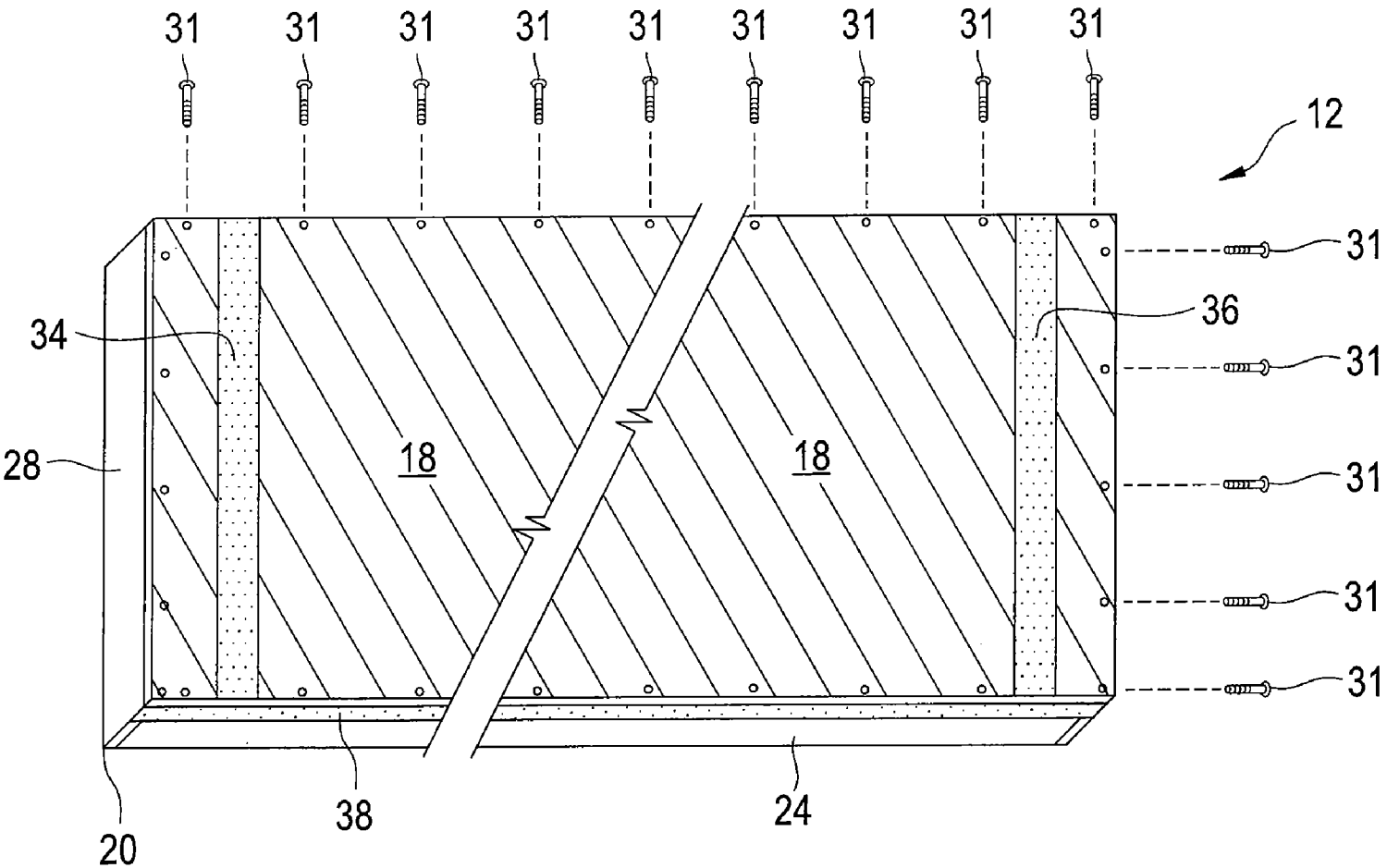
FIG. 3 is a perspective view of the front side of the panel of FIG. 2.

Frame 20 consists of five horizontal reinforcing members each having a preferred length of 95 inches, including three interior members 22, a bottom member 24 and a top member 26, arranged in parallel and coupled to one another by a pair of vertical reinforcing members 28, each having a preferred height of 24 inches and thickness of 0.5 inch and being connected to the respective ends of members 22, 24 and 26 using screws 23. The five horizontal reinforcing members are spaced between vertical reinforcing members 28 to provide four identically sized compartments on the backside or dry side of sheeting 18. Plastic sheeting 18 is attached to frame 20 by arranging sheeting 18 across the horizontal members and forming a continuous plastic weld 30 between the periphery of sheeting 18 and bottom member 24, top member 26 and vertical members 28. It is important that continuous weld 30 be free from all defects that would allow the seepage of water between the sheeting 18 and frame 20. A number of plastic spot welds 32 are also formed between sheeting 18 and interior members 22 to further secure sheeting 18 to frame 20. Preferably, each of plastic spot welds 32 is approximately 4 inches in length and spaced 12 inches apart from adjacent spot welds 32 along the length of each interior member 22. In addition, as illustrated in FIG. 3, a number of screws 31 are used to strengthen the connection of sheeting 18 about its periphery to reinforcing members 24, 26 and 28. Preferably, screws 31 are placed 6 inches apart and 0.125 inch from the periphery of sheeting 18. It is also preferred that screws 31 have beveled heads and be recessed below the surface of sheeting 18.

Referring to FIG. 3, a number of gaskets are secured to the front side or wet side of panels 12 in order to provide a water impermeable seal between panels 12, when stacked one on top of another, and panels 12 and associated columns 14 or 16, when panels 12 are positioned and supported therebetween, as illustrated in FIG. 1. In particular, each panel 12 includes two gaskets 34 and 36 secured to the front side of sheeting 18 and a gasket 38 secured to the exterior or bottom surface of bottom member 24. As illustrated, gasket 34 extends along the front surface of sheeting 18 and between bottom member 24 and top member 26 along the entire height of panel 12 and is arranged adjacent and parallel to one of vertical reinforcing members 28. Similarly, gasket 36 extends along the front surface of sheeting 18 and between bottom member 24 and top member 26 along the entire height of panel 12 but is arranged adjacent and parallel to the other one of vertical reinforcing members 28. Gasket 38, on the other hand, extends along the entire length of bottom member 24. Preferably, gaskets 34, 36 and 38 are silicone sponge gaskets measuring 0.75 inches in width and 0.25 inch in thickness and having an acrylic adhesive backing to allow the gaskets to easily attach to sheeting 18 of panels 12 and bottom member 24. It is also preferred that gaskets 34 and 36 are extended to contact and lie flush against gasket 38 in order to provide a seal therebetween.

Figure 4:
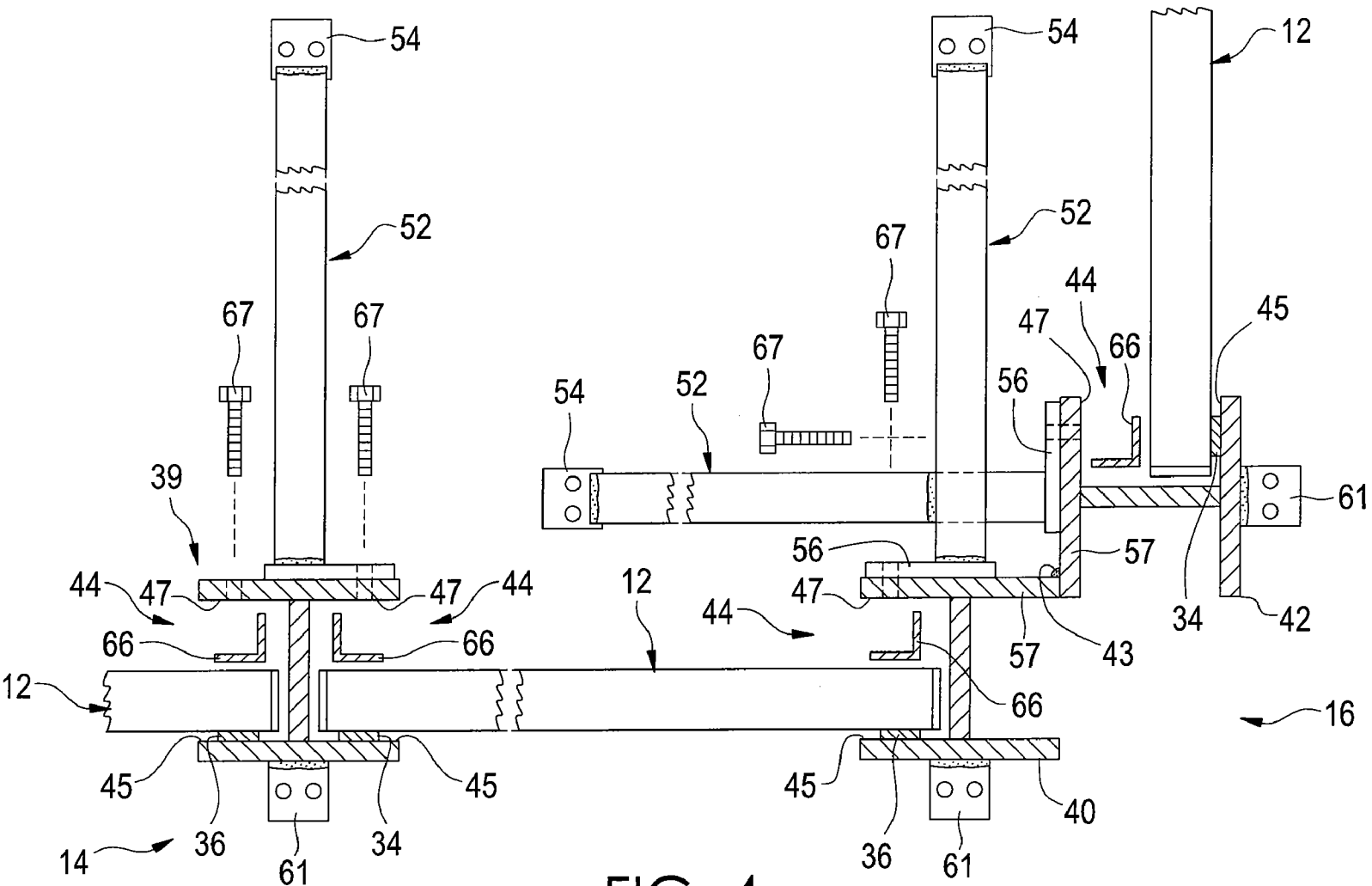
FIG. 4 is a top plan view of columns and associated panel sections of the flood barrier system of FIG. 1.
Figure 5:
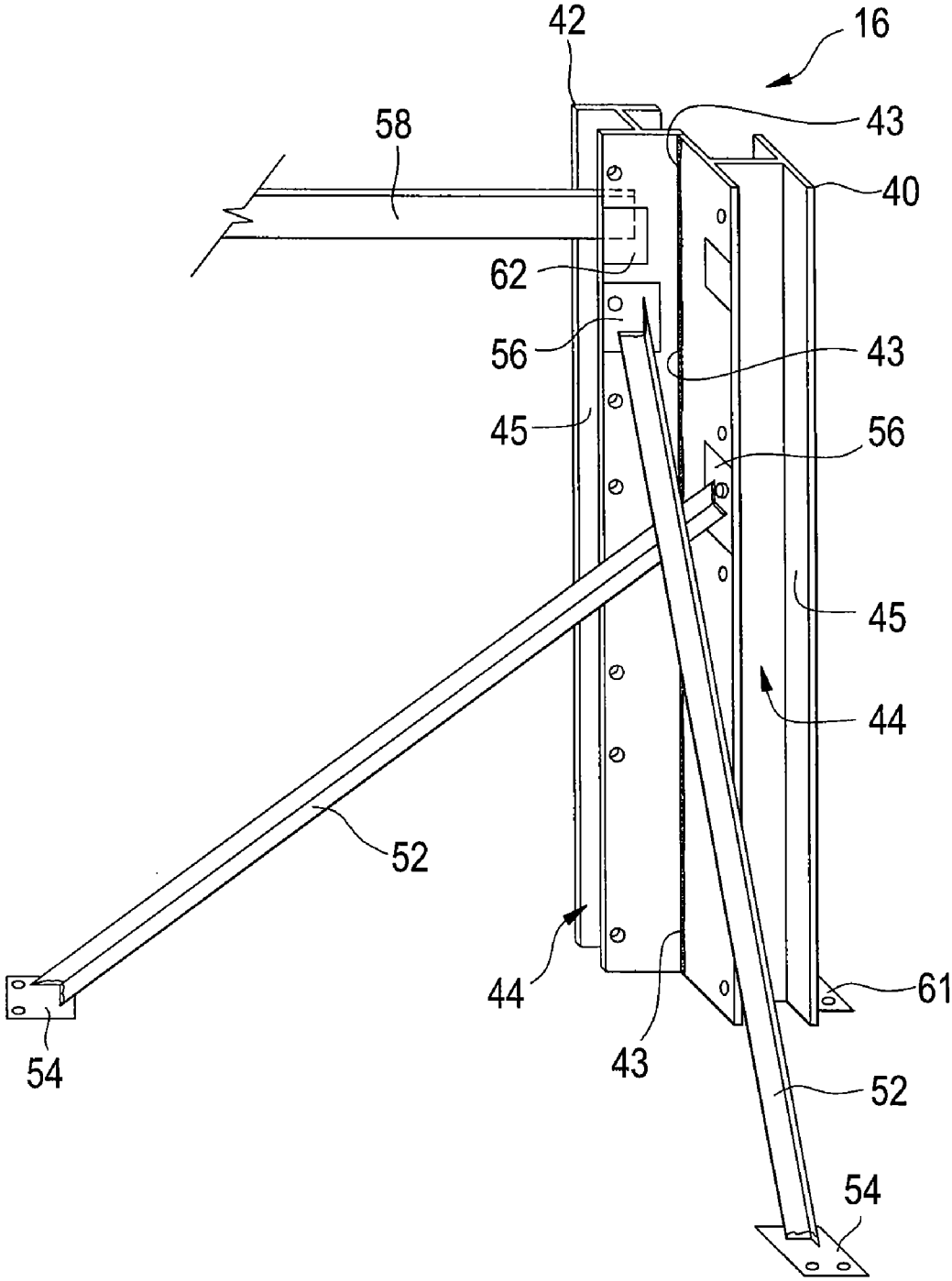
FIG. 5 is a perspective view of the back side of a corner column of the flood barrier system according to FIG. 1.

Referring to FIG. 4, each middle column 14 is comprised of a single beam 39 having an H-shaped cross-section, while each corner column 16 is comprised of two, connected beams 40 and 42, each beam having an H-shaped cross-section. The rear walls or faces 57 of each of beams 40 and 42 are welded to one another at joint 43 along their respective lengths as illustrated in FIGS. 4 and 5. In each instance, beams 39, 40 and 42 have a length sufficient to allow columns 14 and 16 to be securely anchored with foundation 53 and extend therefrom at a ninety degree angle to a height sufficient to support panels 12 stacked to the height necessary to prevent flood waters from rising above barrier 10. Preferably, beams 39, 40 and 42 are conventional steel H-beams having a thickness of 3 inches between front surface 45 and rear surface 47. The H-shaped cross-section of beams 39, 40 and 42 define slots 44 along their entire lengths that are capable of receiving and securing an edge of one or more of panels 12 therein in a stacked manner. Specifically, beam 39 includes a pair of oppositely facing slots 44, each slot 44 having a front surface 45 and a rear surface 47. Beam 40 includes one slot 44 that opens in a direction perpendicular to a second slot 44 defined by the H-shaped cross-section of beam 42. Slots 44 of beams 40 and 42 also include a front surface 45 and a rear surface 47.

Columns 14 and 16 are spaced around a building to be protected at desired intervals, depending on the length of panels 12. The columns are arranged along a continuous, pre-poured concrete foundation 53 having a width not less than 14 inches wide and a depth depending on the soil type in which foundation 53 is poured. With the desired length of panels being approximately 96 inches, it is preferred that columns 14 and 16 are spaced from adjacent columns by a distance of 96 inches. Each beam of columns 14 and 16 is connected with foundation 53 by means of respective anchor plates 61 that are welded to the bottom end of each of beams 39, 40 and 42. Two anchor bolts 63 are used to connect anchor plates 61 to foundation 53.

Figure 6:
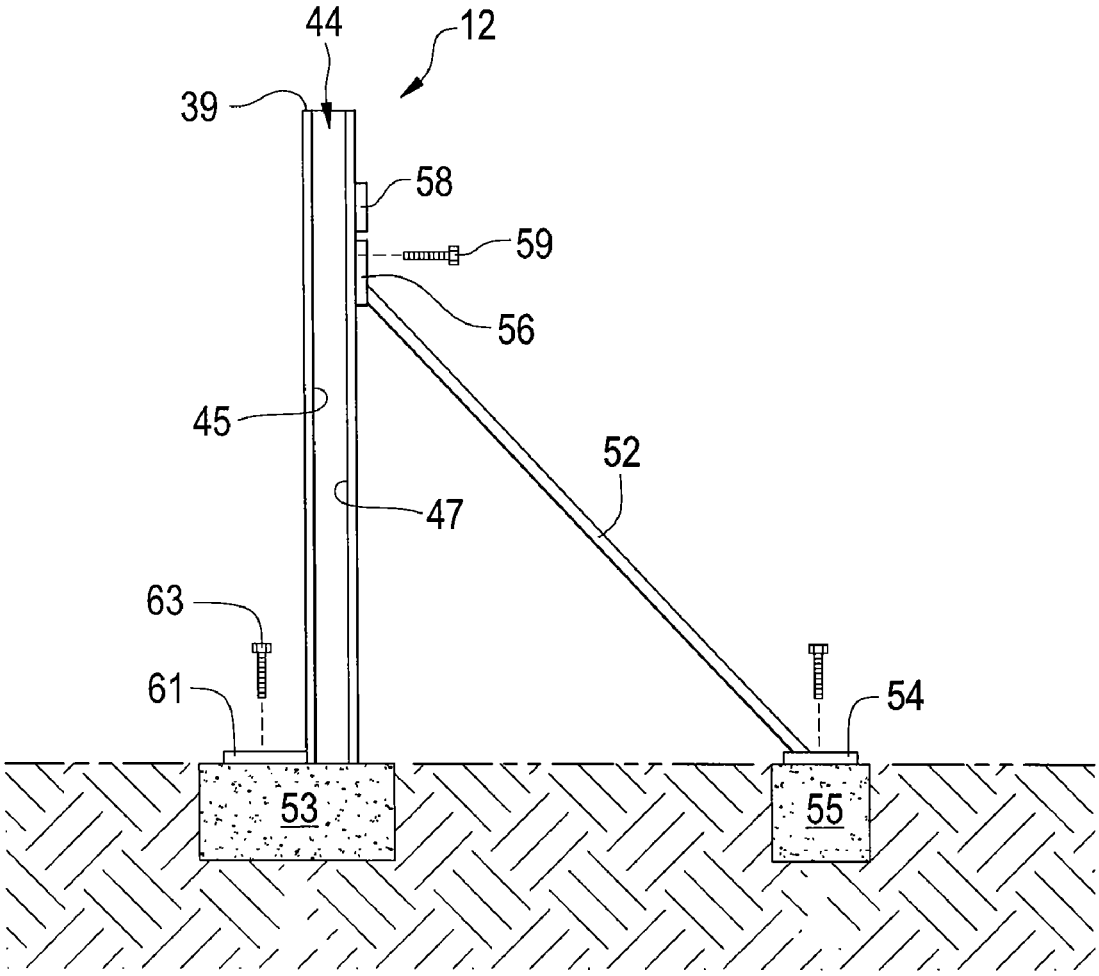
FIG. 6 is a partial cross-sectional, lateral view of a middle column and middle column footing of the flood barrier system of FIG. 1.

Referring to FIGS. 4 through 6, a number of braces are provided on the backside of columns 14 and 16 for strengthening the network of columns and maintaining them in position relative to the ground in which they are anchored and to one another. More particularly, there is provided a number of diagonal braces 52 for shoring up each individual one of beams 39, 40 and 42. Each diagonal brace 52 includes a first anchor plate 54 welded to the bottom end of brace 52 at an angle and arranged to connect with a concrete footing 55 embedded in the ground and a second anchor plate 56 welded to a top end of brace 52 at an angle and arranged to connect with the backside of one of respective beams 39, 40 and 42, by bolts 59. Preferably, diagonal brace 52 is an angle iron measuring 2 inches by 2 inches and having a length of 78 inches and thickness of 0.125 inch. Additionally, there are provided a horizontal brace 58 and an associated pair of vertical braces 60 for each pair of adjacent columns. In particular, each horizontal brace 58 connects to and extends between the upper ends and back sides of two adjacent columns whether it be between two middle columns 14, a middle column 14 and a corner column 16 or two corner columns 16. More specifically, a pair of rectangular mounting tabs 62 are welded to the upper end of the back side of each middle column 14 and corner column 16 for receiving the ends of horizontal brace 58. For middle columns 14, pair of mounting tabs 62 are welded against each beam 39 in combination with one shim placed under the bottom side of each tab 62 and a second shim spaced under the interior, vertical side thereof to provide a pocket for receiving an end of horizontal brace 58 as illustrated, for example, in FIG. 8. For corner columns 16, one tab of pair of mounting tabs 62 is welded against each beam 40 and a second one of pair of tabs 62 is welded against each beam 42. Like with middle columns 14, the tabs 62 welded to corner columns 16 are welded in combination with one shim placed under the bottom side of each tab 62 and a second shim paced under the interior, vertical side thereof to provide a pocket for receiving an end of horizontal brace 58. Preferably, each mounting tab 62, measuring 1 inch in width, 1.5 inches in height and 0.25 inch in thickness, is welded against a respective beam using 0.375 inch shims to provide a pocket having a width of 0.375 inch. Further, it is preferred that each tab 62 is welded to its associated beam at a height of 63.5 inches above the surface of the ground in which the beam is anchored. To further support horizontal brace 58, pair of vertical braces 60 are secured to and between a middle section of each horizontal brace 58 and foundation 53. Each brace of pair of vertical braces 60 couples to both horizontal brace 58 and foundation 53 at a ninety degree angle. A pin 64 is used to connect each brace of pair of vertical braces 60 to foundation 53. Preferably, each vertical brace is a 63.5 inch long, 2 inch by 2 inch by 0.25 angle iron, and each pin 64 is a round steel pin having a length of 6 inches and a diameter of 0.5 inch. Horizontal braces 58 and vertical braces 60 are provided in order to prevent flexing or bowing of panels 12, which could compromise the seal formed by gaskets 34, 36 and 38.

Figure 7:
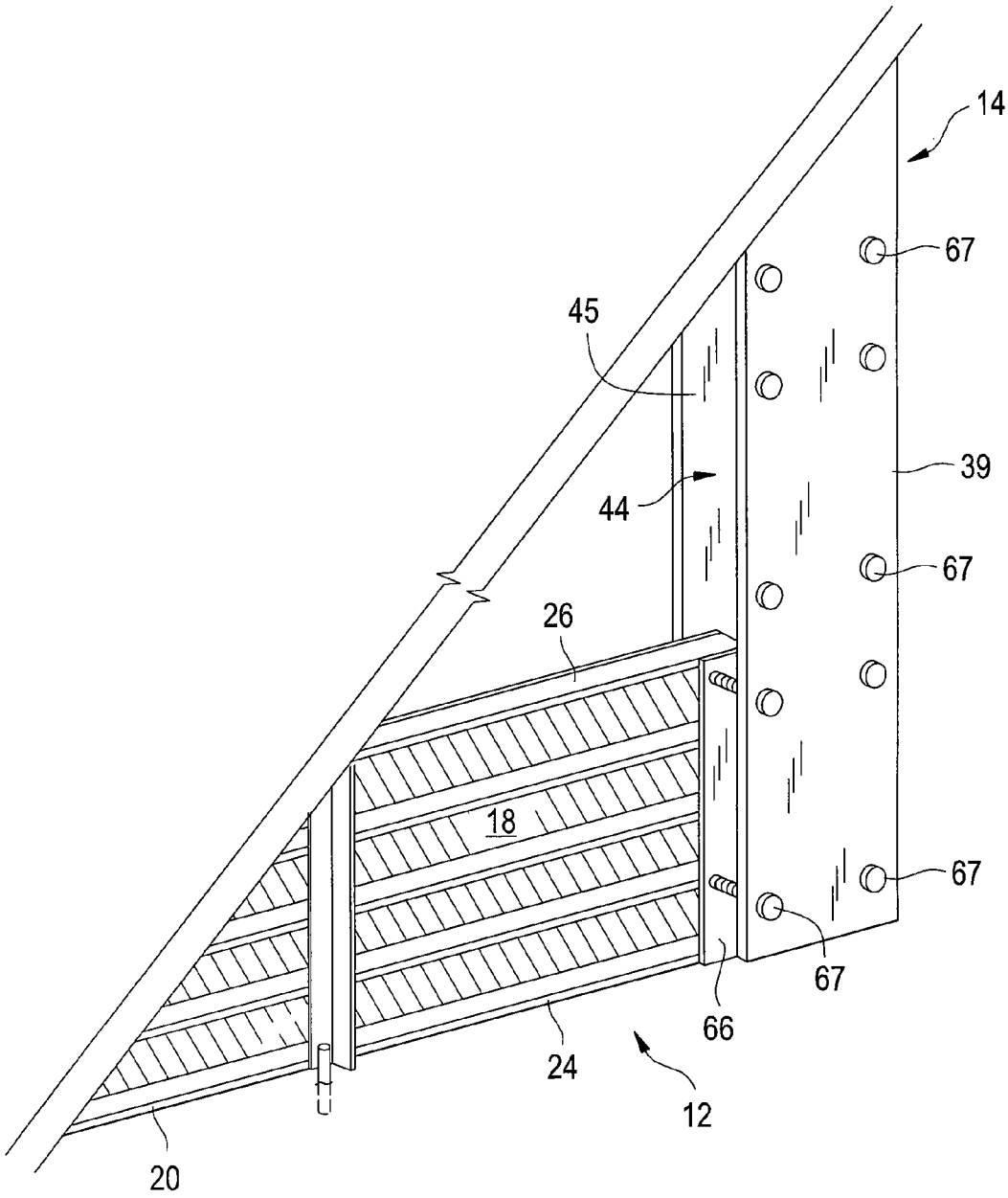
FIG. 7 is a perspective view of the back side of a middle column and associated panel of the flood barrier system according to FIG. 1.
Figure 8:
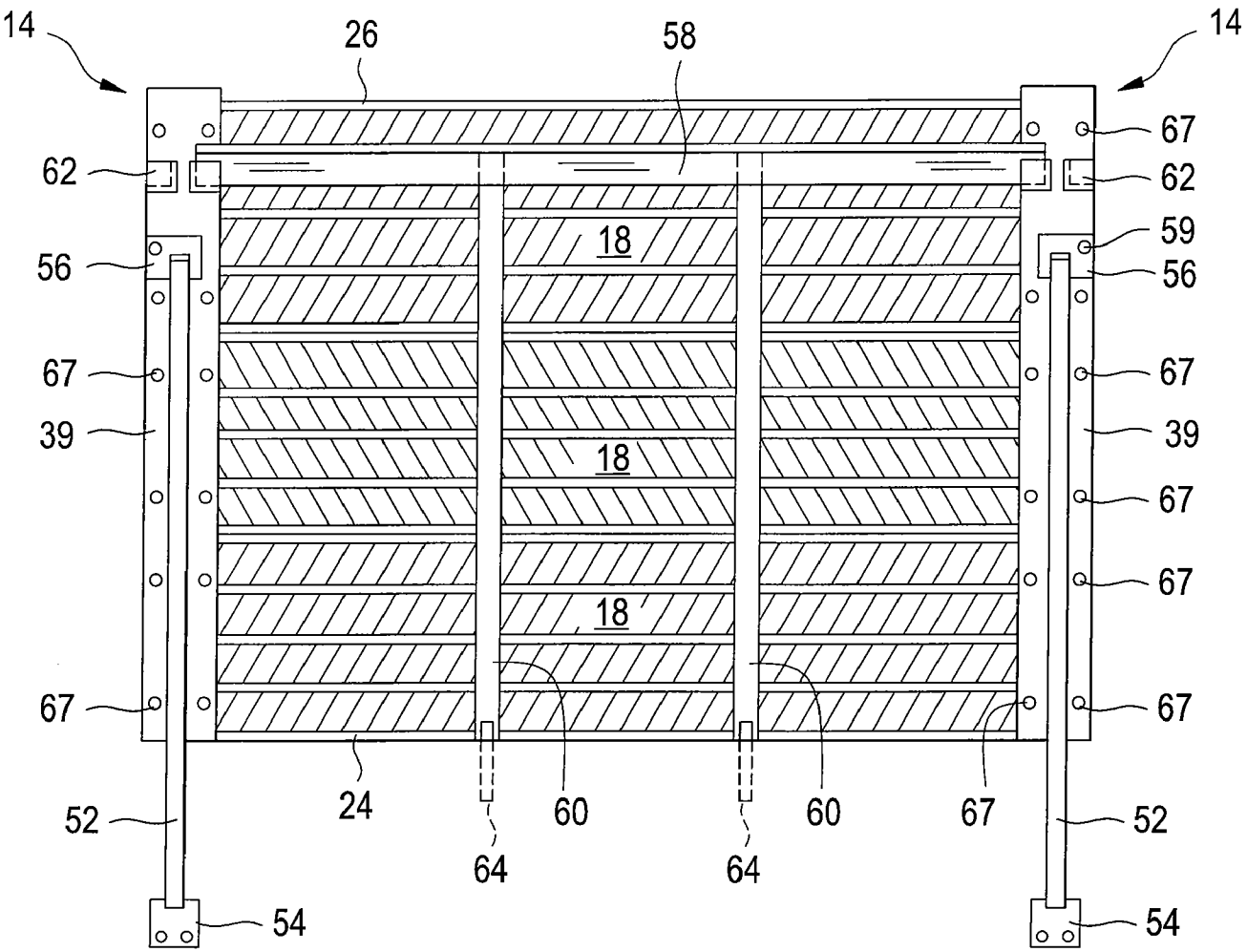
FIG. 8 is a plan view of the back side of two middle columns and associated panel section of the flood barrier system according to FIG. 1.

In use, panels 12 are stacked within the network of columns comprised of middle columns 14 and corner columns 16. When it is desired to place panels 12 in a substantially straight line, panels 12 are stacked between two middle columns 14. Alternately, when it is desired that panels 12 be placed at right angles to one another, panels 12 are stacked between two columns including at least one corner column 16. More particularly, once columns 14 and 16 of barrier 10 are erected and it is desired to shield a structure surrounded by the columns from flood waters, panels 12 are inserted between a set of adjacent columns and stacked to a desired height with gaskets 34 and 36 of stacked panels 12 being positioned within the opposing slots 44 of the respective columns. The interaction of gaskets 38 of the stacked panels 12 with the top members 26 of the stacked panels 12 forms a seal that prevents the movement of water therebetween. Likewise, to prevent the movement of water between the stacked panels 12 and the columns between which they are stacked, gaskets 34 and 36 of the stacked panels 12 are pressed against the front surfaces 45 of the slots 44 of the respective columns wherein they are positioned. The force necessary to produce a water-impermeable seal between the slots 44 and gaskets 34 and 36 of the stacked panels 12 is provide by placing a pressing member 66 between each of the stacked panels 12 and the rear surface 47 of each associated slot 44. Preferably, pressing member 66 is a 1 inch by 1 inch by 0.125 angle iron having a length of 24 inches. As illustrated in FIGS. 4 and 7, a pair of bolts 67 are threaded through rear surface 47 of the slots 44 and rotated to move forward against pressing member 66 causing pressing member 66, in turn, to press against the panel 12 thus forcing one or more of gaskets 34 and 36 to press against the front surface 45 of slot 44 to form a seal therebetween. With water-impermeable seals created between the individual water-impermeable stacked panels 12, the stacked panels 12 and foundation 53 and the stacked panels 12 and adjacent columns 14 or 16, barrier 10 presents an apparatus that effectively walls off the protected structure from most sources of flood waters.

While the invention is described in connection with a specific embodiment thereof, it is to be clearly understood that this is done only by way of example, and not as a limitation to the scope of my invention, as set forth in the objects thereof and in the appended claims.

It is claimed:

1. A flood barrier comprising, a plurality of panels, each panel including a water-impermeable sheet arranged on a frame to provide a substantially water-impermeable surface there across, the frame including a top side, a bottom side, a pair of lateral sides and a plurality of reinforcement pieces connected to and between the pair of lateral sides; a first gasket adhered to a front of the sheet and extending between the top side and the bottom side adjacent to one of the pair of lateral sides; a second gasket adhered to the front of the sheet and extending between the top side and the bottom side adjacent to the other one of the pair of lateral sides; a third gasket adhered to a bottom surface of the bottom side, a first column having an essentially H-shaped cross-section and a first panel receiving slot defined by said cross-section, the first column being coupled to the ground, a second column having an essentially H-shaped cross-section and a second panel receiving slot defined by said cross-section, the second column being coupled to the ground, wherein the plurality of panels are stacked and arranged between the first column and the second column with the first gasket of each panel being pressed against the first panel receiving slot and the second gasket of each panel being pressed against the second panel receiving slot.

2. The flood barrier according to claim 1 further comprising a brace coupled to and between the ground and a rear side of the first column at a point within the upper two thirds of the first column.

3. The flood barrier according to claim 1 further comprising a horizontal brace connected to and between the first column and the second column and a pair of vertical braces coupled to and between the horizontal brace and the ground.

4. The flood barrier according to claim 3 wherein the pair of vertical braces extend parallel to and contact with one or more panels of the plurality of panels.

5. The flood barrier according to claim 1 further comprising a first pressing means for pressing the first gasket of one or more panels of the plurality of panels against the first panel receiving slot and a second pressing means for pressing the second gasket of one or more panels of the plurality of panels against the second panel receiving slot.

6. The flood barrier according to claim 5 wherein the first pressing means includes an elongate angled piece arranged within a space defined between the plurality of panels and the first panel receiving slot and a plurality of screw members arranged within a rear side of the first column for pressing the angled piece against the one or more panels of the plurality of panels when the screw members are turned.

7. The flood barrier according to claim 1 wherein the sheet and frame are plastic.

8. The flood barrier according to claim 1 wherein first column and the second column are coupled to the ground with a continuous, concrete foundation.

9. A flood barrier comprising:

a plurality of panels, each panel including a plastic sheet coupled to a frame to provide a substantially water-impermeable surface there across, the frame including a top side, a bottom side, a pair of lateral sides and a plurality of reinforcement pieces connected between the pair of lateral sides; a first gasket adhered to a front of the sheet and extending between the top side and the bottom side adjacent to one of the pair of lateral sides; a second gasket adhered to the front of the sheet and extending between the top side and the bottom side adjacent to the other one of the pair of lateral sides; a third gasket adhered to a bottom surface of the bottom side, a first column having an essentially H-shaped cross-section and a first panel receiving slot, the first column being anchored to the ground, a second column including a first elongate piece having an H-shaped cross-section and a second panel receiving slot and a second elongate piece connected along the length thereof directly to the first elongate piece and having an H-shaped cross-section and a third panel receiving slot, wherein the plurality of panels are stacked and arranged between the first column and the second column with the first gasket of each panel being pressed against the first panel receiving slot and the second gasket of each panel being pressed against the second panel receiving slot.

10. The flood barrier according to claim 9 further comprising a first brace connected to and between an upper portion the first elongate piece and a first footing anchored within the ground and a second brace connected to and between an upper portion of the second elongate piece and a second footing anchored within the ground.

11. The flood barrier according to claim 10 wherein the first brace is connected with a rear side of the first elongate piece and the second brace is connected with a rear side of the second elongate piece.

12. The flood barrier according to claim 9 comprising another plurality of panels stacked and arranged within the third panel receiving slot.

13. The flood barrier according to claim 9 further comprising an angle iron adapted and arranged for pressing the second gasket of one or more panels of the plurality of panels against the second panel receiving slot.

14. The flood barrier of claim 13 wherein the angle is arranged within a space defined between the plurality of panels and the second panel receiving slot and a plurality of screw members are provided that are adapted and arranged to press the angle iron against the one or more panels of the plurality of panels when rotated within the first elongate piece.

15. A method of protecting an area from flooding comprising, providing a plurality of panels, each panel including a water-impermeable sheet arranged on a frame to provide a substantially water-impermeable surface there across, the frame including a top side, a bottom side, a pair of lateral sides and a plurality of reinforcement pieces connected and between the pair of lateral sides; a first gasket adhered to a front of the sheet and extending between the top side and the bottom side adjacent to one of the pair of lateral sides; a second gasket adhered to the front of the sheet and extending between the top side and the bottom side adjacent to the other one of the pair of lateral sides; a third gasket adhered to a bottom surface of the bottom side, and erecting a pair of columns outside of the area to be protected, each column having an H-shaped cross section and a panel receiving slot, and stacking the plurality of panels one panel on top of another panel between the pair of columns with the first gasket of each panel being pressed against the panel receiving slot of one of the pair of columns and the second gasket being pressed against the panel receiving slot of the other one of the pair of columns.

16. The method according to claim 15 wherein each column of the pair of columns is anchored to the ground by a concrete foundation that extends between the pair of columns.

17. The method according to claim 16 further comprising connecting a horizontal brace to and between each of the pair of columns and connecting a pair of vertical braces to and between the horizontal brace and the foundation.

18. The method according to claim 15 further comprising pressing and holding the first gasket of one or more panels of the plurality of panels against the panel receiving slot of one of the pair of columns.

19. The method according to claim 15 further comprising erecting a corner column including a first elongate piece having an H-shaped cross-section and a first panel receiving slot and a second elongate piece connected along its length directly to the first elongate piece and having an H-shaped cross-section, and stacking another plurality of panels between the corner column and one of the pair of columns and within the first panel receiving slot.

20. The method according to claim 17 further comprising bracing at least one of the pair of columns against the ground with a diagonal brace.

* * * * *